US007586451B2

(12) United States Patent
Lee et al.

(10) Patent No.: US 7,586,451 B2
(45) Date of Patent: Sep. 8, 2009

(54) BEAM-TILTED CROSS-DIPOLE DIELECTRIC ANTENNA

(75) Inventors: Kwan-ho Lee, Ann Arbor, MI (US); Wladimiro Villarroel, Ypsilanti, MI (US); Nuttawit Surittikul, Ann Arbor, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 384 days.

(21) Appl. No.: 11/738,205

(22) Filed: Apr. 20, 2007

(65) Prior Publication Data

US 2008/0129619 A1 Jun. 5, 2008

Related U.S. Application Data

(60) Provisional application No. 60/868,452, filed on Dec. 4, 2006.

(51) Int. Cl.
*H01Q 1/32* (2006.01)
*H01Q 1/38* (2006.01)
*H01Q 9/38* (2006.01)

(52) U.S. Cl. ..... 343/713; 343/700 MS; 343/829

(58) Field of Classification Search ..... 343/713, 343/700 MS, 829, 850, 860
See application file for complete search history.

(56) References Cited

U.S. PATENT DOCUMENTS 4,125,838 A 11/1978 Kaloi
4,151,530 A 4/1979 Kaloi
4,564,842 A 1/1986 Suzuki
5,241,321 A 8/1993 Tsao
5,243,353 A 9/1993 Nakahara et al.
5,633,645 A * 5/1997 Day ..... 343/700 MS
5,703,601 A 12/1997 Nalbandian et al.
5,952,970 A 9/1999 Kawahata
5,959,594 A 9/1999 Wu et al.
6,163,306 A 12/2000 Nakamura et al.
6,166,692 A * 12/2000 Nalbandian et al. ... 343/700 MS
6,222,489 B1 4/2001 Tsuru et al.
6,271,800 B1 8/2001 Nakamura et al.
6,288,679 B1 9/2001 Fischer et al.
6,339,406 B1 1/2002 Nesic et al.
6,346,913 B1 2/2002 Chang
7,126,539 B2 10/2006 Li et al.
7,295,167 B2 * 11/2007 Aminzadeh et al. ..... 343/713
2005/0179610 A1 8/2005 Le

* cited by examiner

*Primary Examiner*—Shih-Chao Chen
(74) *Attorney, Agent, or Firm*—Howard & Howard Attorneys PLLC

(57) ABSTRACT

An antenna for radiating an electromagnetic field includes a ground plane, a first dielectric layer disposed on the ground plane, and a second dielectric layer disposed on the first dielectric layer. The antenna includes at least one feeding element embedded in the first dielectric layer and a radiating element extending from the feeding element. The radiating element is embedded within the first dielectric layer adjacent to the second dielectric layer. A beam steering element is embedded in the second dielectric layer and electromagnetically coupled to the radiating element. Embedding the beam steering element in the second dielectric layer and electromagnetically coupling the beam steering element to the radiating element allows the antenna to tilt a radiation beam to overcome a roof obstruction from a vehicle while maintaining acceptable gain, polarization, and directional properties for SDARS applications.

42 Claims, 4 Drawing Sheets

BEAM-TILTED CROSS-DIPOLE DIELECTRIC ANTENNA

CROSS REFERENCE TO RELATED APPLICATION

This application claims the benefit of provisional patent application Ser. No. 60/868,452 filed Dec. 4, 2006.

BACKGROUND OF THE INVENTION

1. Field of the Invention

The present invention generally relates to an antenna for radiating electromagnetic waves.

2. Description of the Related Art

Satellite Digital Audio Radio Service (SDARS) providers use satellites to broadcast RF signals, particularly circularly polarized RF signals, back to Earth. SDARS providers use multiple satellites in a geostationary orbit or in an inclined elliptical constellation. The elevation angle between the respective satellite and the antenna is variable depending on the location of the satellite and the location of the antenna. Within the continental United States, this elevation angle may be as low as 20 degrees. Accordingly, specifications of the SDARS providers require a relatively high gain at elevation angles as low as 20 degrees.

The automotive industry is increasingly including antennas with SDARS applications in vehicles, and specifically mounted to automotive glass. However, certain parts of the vehicle, such as a roof, may block RF signals and prevent the RF signals from reaching the antenna at certain elevation angles. Even if the roof does not block the RF signals, the roof may mitigate the RF signals, which may cause the RF signal to degrade to an unacceptable quality. When this happens, the antenna is unable to receive the RF signals at those elevation angles and the antenna is unable to maintain its intrinsic radiation pattern characteristic. Thus, antenna performance is severely affected by the roof obstructing reception of the RF signals, especially for elevation angles below 30 degrees. In order to overcome this, a radiation beam tilting technique can be used to compensate for signal mitigation caused by the vehicle body. Since antennas capable of receiving RF signals in SDARS frequency bands are typically physically smaller than those antennas receiving signals in lower frequency bands, it becomes challenging to tilt the antenna radiation main beam from the normal direction to the antenna plane, which is substantially parallel to the glass where the antenna is mounted.

One such antenna implementing a radiating beam tilting technique is disclosed in U.S. Pat. No. 7,126,539 (the '539 patent). The '539 patent discloses an antenna having a ground plane and a first dielectric layer disposed on the ground plane. A second dielectric layer having a relative permittivity different than that of the first dielectric layer is disposed adjacent to the first dielectric layer. A feeding element is embedded in the first dielectric layer adjacent to the second dielectric layer. The antenna of the '539 patent produces a directional radiation beam with a highest gain portion at a certain elevation angle. Due to the difference between the relative permittivity of the second dielectric layer compared to the first dielectric layer, the radiation beam tilts from a higher to lower elevation angle, thus tilting the highest gain portion, accordingly. However, the antenna of the '539 patent is only able to tilt the radiation beam in one direction. At lower elevation angles, the roof of the vehicle causes too much signal mitigation.

Although the antennas of the prior art may receive a relatively high gain at relatively low elevation angles, an antenna is needed for SDARS applications that provides a radiation beam with omnidirectionality at lower elevation angles when mounted on a tilted pane (i.e., a window) of a vehicle while maintaining acceptable gain, polarization, and directionality properties.

SUMMARY OF THE INVENTION AND ADVANTAGES

The subject invention provides an antenna comprising a ground plane and a first dielectric layer disposed on the ground plane. A second dielectric layer disposed on the first dielectric layer. The antenna further includes at least one feeding element embedded in the first dielectric layer, and a radiating element extending from the feeding element and embedded within the first dielectric layer adjacent to the second dielectric layer. A beam steering element is embedded in the second dielectric layer and electromagnetically coupled to the at least one radiating element.

Embedding the beam steering element in the second dielectric layer and electromagnetically coupling the beam steering element to the radiating element allows the antenna to tilt a radiation beam as much as 20 degrees. When mounted on a tilted pane, tilting the beam with the beam steering element reduces signal mitigation or blocking of a signal, and thus, maintains acceptable gain, circular polarization, and directional properties for SDARS applications at lower elevation angles. Therefore, the beam steering element is suitable for SDARS applications and provides a radiation beam with substantial omnidirectionality at lower elevation angles when mounted on a tilted pane (i.e., a window) of a vehicle while maintaining acceptable gain, polarization, and directionality properties.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, an antenna for radiating an electromagnetic field is shown generally at 10. In the illustrated embodiments, the antenna 10 is utilized to receive a circularly polarized radio frequency (RF) signal from a satellite. Those skilled in the art realize that the antenna 10 may also be used to transmit the circularly polarized RF signal. Specifically, the antenna 10 receives a left-hand circularly polarized (LHCP) RF signal like those produced by a Satellite Digital Audio Radio Service (SDARS) provider, such as XM® Satellite Radio or SIRIUS® Satellite Radio. However, it is to be understood that the antenna 10 may also receive a right-hand circularly polarized (RHCP) RF signal.

Figure 1:
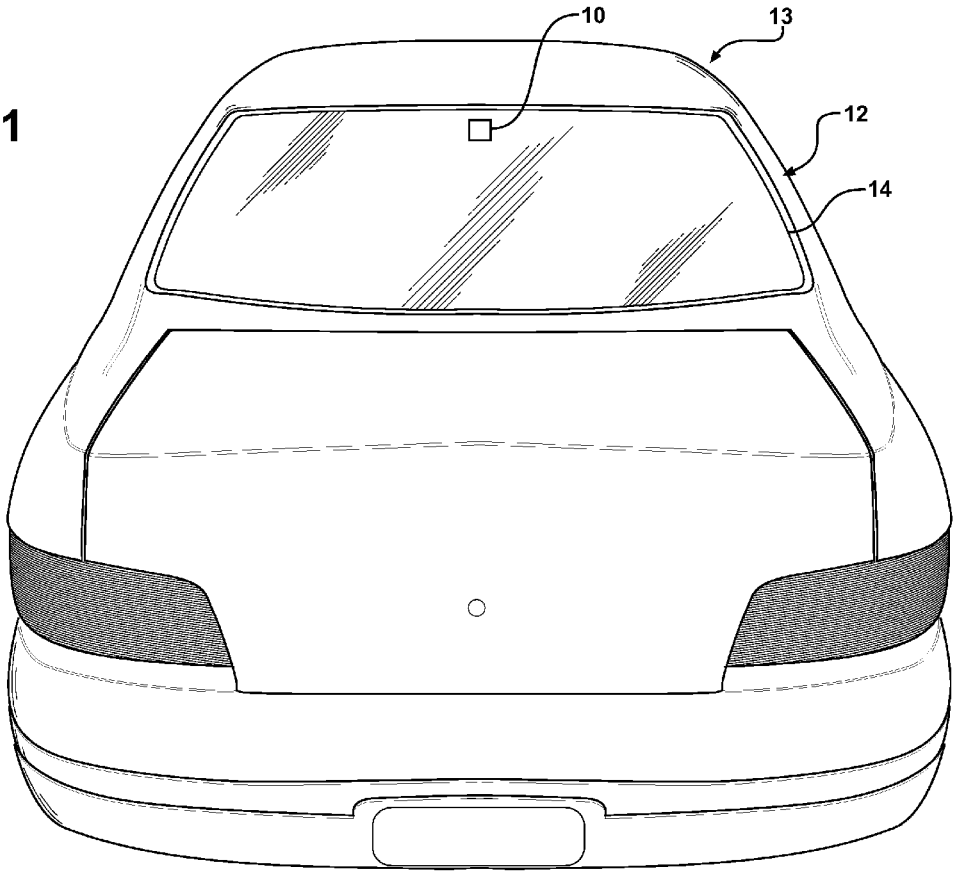
FIG. 1 is a perspective view of a vehicle having an antenna disposed on a non-conductive pane.

As shown in FIG. 1, the antenna 10 may be mounted to a window 12 of a vehicle 13. The window 12 may be a rear window 12 (backlite), a front window 12 (windshield), or any other window 12 or tilted pane of the vehicle 13. The antenna 10 may also be implemented in other situations completely separate from the vehicle 13, such as on a building or integrated with a radio receiver. Additionally, the antenna 10 may be disposed at other locations of the vehicle 13, such as on a side mirror.

Multiple antennas may be implemented as part of a diversity system of antennas. For instance, the vehicle 13 of the preferred embodiment may include a first antenna on the windshield and a second antenna on the backlite. These antennas would both be electrically connected to a receiver (not shown) within the vehicle 13. Those skilled in the art realize several processing techniques may be used to achieve diversity reception. In one such technique, a switch (not shown) may be implemented to select the antenna 10 that is currently receiving a stronger RF signal from the satellite.

The preferred window 12 includes at least one non-conductive pane 14. The term "non-conductive" refers to a material, such as an insulator or dielectric, that when placed between conductors at different potentials, permits only a small or negligible current in phase with the applied voltage to flow through material. Typically, non-conductive materials have conductivities on the order of nanosiemens/meter.

In the illustrated embodiments, the non-conductive pane 14 is implemented as at least one pane of glass. Of course, the window 12 may include more than one pane of glass. Those skilled in the art realize that automotive windows, particularly windshields, may include two panes of glass sandwiching an adhesive interlayer. The adhesive interlayer may be a layer of polyvinyl butyral (PVB). Of course, other adhesive interlayers would also be acceptable. The non-conductive pane 14 is preferably automotive glass and more preferably soda-lime-silica glass. The pane of glass defines a thickness between 1.5 and 5.0 mm, preferably 3.1 mm. The pane of glass also has a relative permittivity between 5 and 9, preferably 7. Those skilled in the art, however, realize that the non-conductive pane 14 may be formed from plastic, fiberglass, or other suitable non-conductive materials. Furthermore, the non-conductive pane 14 preferably functions as a radome for the antenna 10. That is, the non-conductive pane 14 protects the other components of the antenna 10 from moisture, wind, dust, etc. that are present outside the vehicle 13.

As best shown in FIGS. 2, 4, 5, and 7, the antenna 10 includes a ground plane 16 for reflecting energy received by the antenna 10. The ground plane 16 is disposed substantially parallel to and spaced from the non-conductive pane 14 and is typically formed of a generally flat electrically conductive material like copper or aluminum having at least one planar surface. The ground plane 16 generally defines a rectangular shape, and specifically a square shape, although those skilled in the art realize the ground plane 16 may have different shapes or configurations.

A first dielectric layer 18 is disposed on the ground plane 16. The first dielectric layer 18 provides support to the antenna 10 and may generally define a rectangular shape, specifically a square shape. Those skilled in the art realize that other shapes of the first dielectric layer 18 may be implemented. A second dielectric layer 20 is disposed on the first dielectric layer 18. When mounted to the vehicle 13, the second dielectric layer 20 is disposed between the first dielectric layer 18 and the non-conductive pane 14. Like the first dielectric layer 18, the second dielectric layer 20 may also generally define a rectangular shape, and specifically a square shape. Those skilled in the art realize that other shapes of the second dielectric layer 20 may be implemented.

The first and second dielectric layers 18, 20 each have a relative permittivity between 1 and 100. Preferably, the relative permittivity of the second dielectric layer 20 is different than the relative permittivity of the first dielectric layer 18. For example, the first dielectric layer 18 may be a plastic and, as shown in the Figures, the second dielectric layer 20 may be an air gap. In this example, a spacer 21 may be used to establish a proper thickness of the second dielectric layer 20 (i.e., the air gap). Alternatively, an antenna housing or radome (not shown) may be used to establish the thickness of the second dielectric layer 20. It is to be appreciated that the first and second dielectric layers 18, 20 may be formed from other materials. The difference between the relative permittivity of the first and second dielectric layers 18, 20 may be dependent upon the SDARS application and the characteristics of the signal received by the antenna 10.

The antenna 10 further includes at least one feeding element 24 that is electrically isolated from the ground plane 16. Preferably, the feeding element 24 is formed from an electrically conductive wire, or alternatively, the feeding element 24 may be formed from a strip. In one embodiment, the at least one feeding element 24 is further defined as a plurality of feeding elements 24. Each of the at least one feeding elements 24 is embedded in the first dielectric layer 18. Preferably, the feeding element 24 is partially surrounded by the first dielectric layer 18, and/or substantially perpendicular to the ground plane 16. The feeding elements 24 are spaced from one another in the first dielectric layer 18. For instance, the feeding elements 24 may be approximately 1 mm apart. However, it is to be appreciated that the feeding elements 24 may be spaced from one another at different distances.

A radiating element 26 extends from the feeding element 24 and acts as the primary radiating element for the antenna 10. The radiating element 26 is embedded within the first dielectric layer 18 adjacent to the second dielectric layer 20, and preferably, the radiating element 26 is flush with a top surface of the first dielectric layer 18 while in physical contact with the second dielectric layer 20. The at least one radiating element 26 may be further defined as a plurality of radiating elements 26. The plurality of radiating elements 26 are embedded in the first dielectric layer 18 preferably perpendicular to the feeding elements 24 and coplanar relative to one another.

Figure 2:
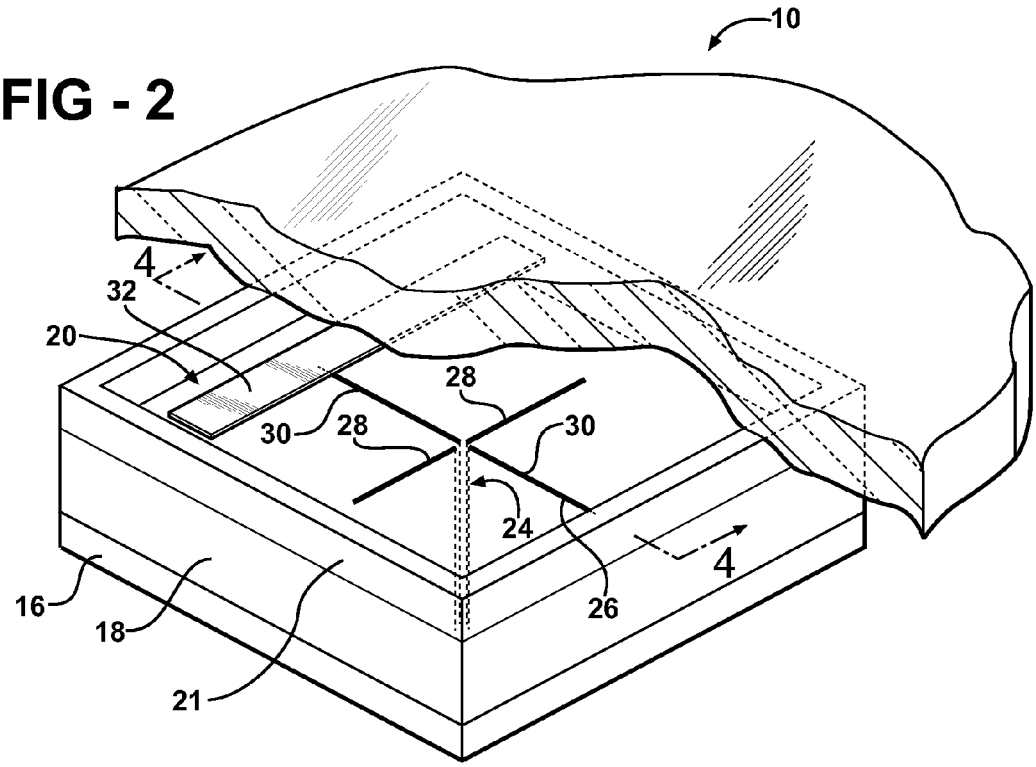
FIG. 2 is a perspective view of the antenna disposed on the non-conductive pane and having a beam steering element and a plurality of feeding elements and a plurality of radiating elements arranged in a cross-dipole configuration.
Figure 3:
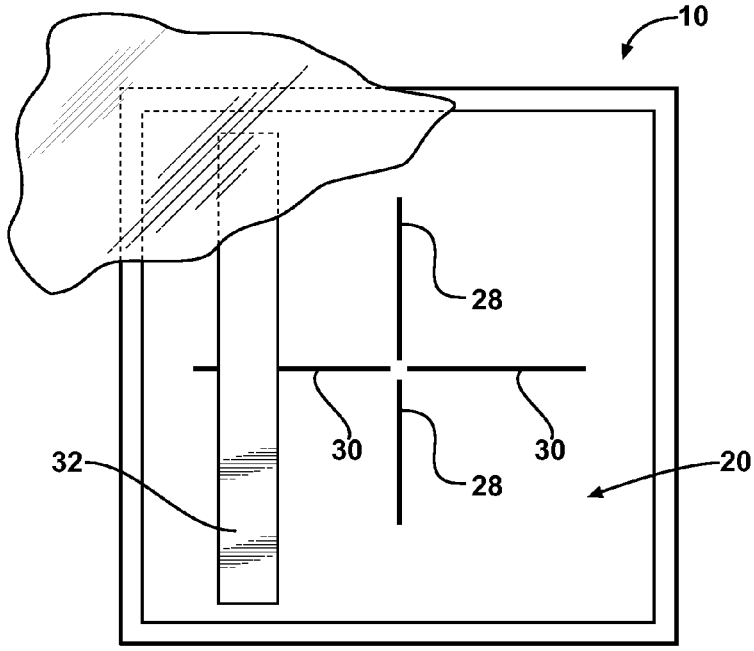
FIG. 3 is a top view of the antenna of FIG. 2.
Figure 4:
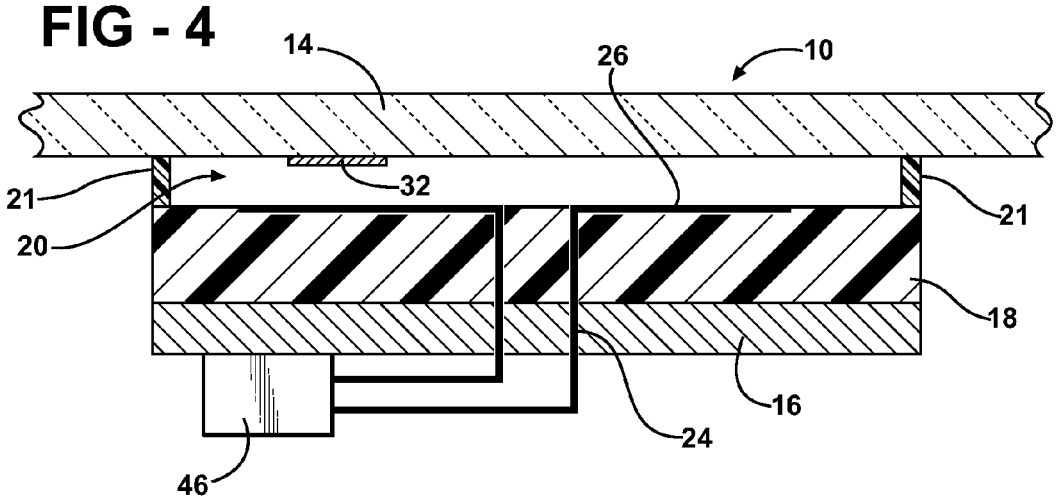
FIG. 4 is a cross-sectional side view of the antenna of FIG. 2 taken along the line 4-4 in FIG. 2.
Figure 5:
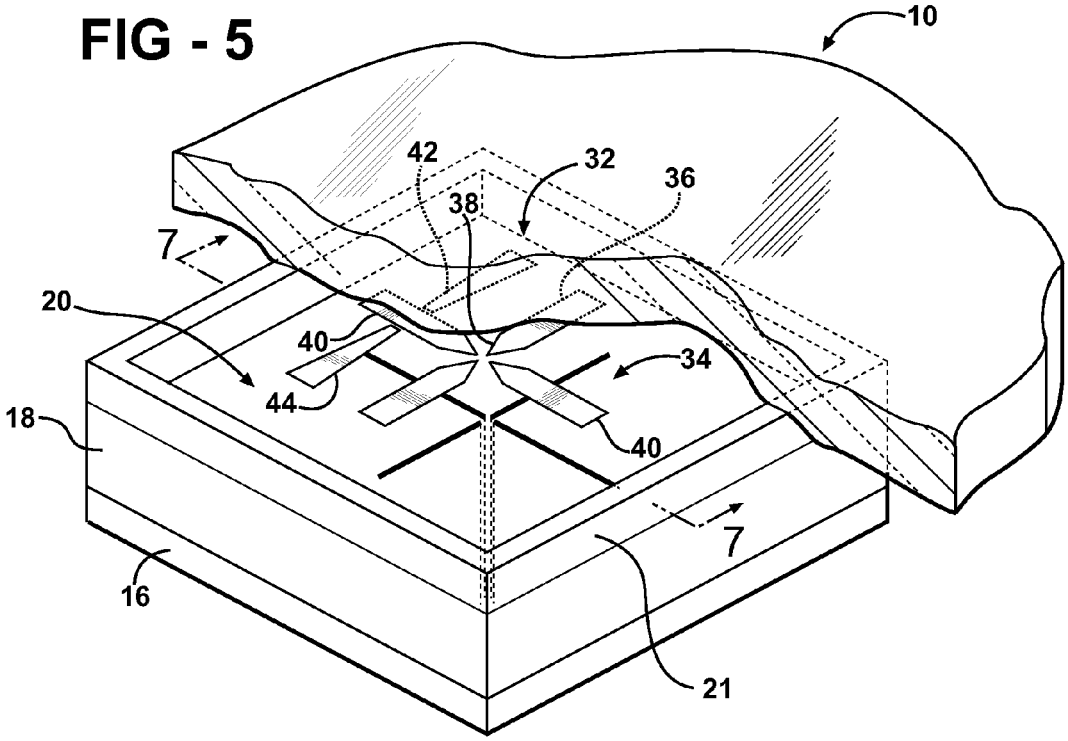
FIG. 5 is a perspective view of another embodiment of the antenna disposed on the non-conductive pane and having the beam steering element, an impedance matching element, and the plurality of feeding elements and the plurality of radiating elements arranged in a cross-dipole configuration.

To achieve circular polarization, it is preferred that the plurality of feeding elements 24 and the plurality of radiating elements 26 are arranged in a cross-dipole configuration. The cross-dipole configuration of the feeding elements 24 and the radiating elements 26 is best illustrated in FIGS. 2, 3, and 5. Those skilled in the art realize that the term "cross-dipole" is a term of art in the field of antennas. Preferably, in the cross-dipole configuration, the antenna 10 includes four feeding elements 24 and four radiating elements 26 to establish the cross-dipole configuration. The feeding elements 24 are embedded in the first dielectric layer 18 substantially perpendicular to the ground plane 16 and the non-conductive pane 14. The radiating elements 26 are embedded in the first dielectric layer 18 parallel to and spaced from the ground plane 16. The four feeding elements 24 and the four radiating elements 26 form a first dipole 28 and a second dipole 30 spaced from the first dipole 28. The first and second dipoles 28, 30 transmit or receive at least one first dipole signal and at least one second dipole signal, respectively. In other words, the signal transmitted or received by the first dipole 28 is the first dipole signal, and the signal transmitted or received by the second dipole 30 is the second dipole signal. The first and second dipole signals have equal amplitudes relative to one another and a phase difference of 90 degrees respectively, to facilitate circular polarization characteristics. Preferably, the first dipole 28 is formed from two of the feeding elements 24 and two of the radiating elements 26. Likewise, the second dipole 30 is formed from two of the feeding elements 24 and two of the radiating elements 26. The radiating elements 26 in the first dipole 28 extend in a direction transverse to the radiating elements 26 in the second dipole 30. Specifically, the radiating elements 26 in the first dipole 28 are orthogonal to the radiating elements 26 in the second dipole 30, thus establishing the cross-dipole configuration.

Referring now to FIGS. 2-6, the antenna 10 further includes a beam steering element 32 for disturbing a current flow to control a radiation direction of the antenna 10. The beam steering element 32 is embedded in the second dielectric layer 20 and electromagnetically coupled to the at least one radiating element 26. In other words, the beam steering element 32 is at least partially disposed inside the second dielectric layer 20 and spaced from and electromagnetically coupled to the radiating element 26. Embedding the beam steering element 32 in the second dielectric layer 20 and electromagnetically coupling the beam steering element 32 to the radiating element 26 allows the antenna 10 to tilt a radiation beam as much as 20 degrees. Titling the beam with the beam steering element 32 reduces signal mitigation or blocking of the signal, such that, when mounted on the window 12 or other tilted pane of the vehicle 13 will result in the antenna 10 receiving the SDARS signal in a substantially omnidirectional pattern. Thus, the antenna 10 maintains acceptable gain, polarization, and directional properties for SDARS applications at lower elevation angles. Therefore, the beam steering element 32 is suitable for SDARS applications. Preferably, the beam steering element 32 is disposed on the non-conductive pane 14 and embedded in the second dielectric layer 20 parallel to the first dielectric layer 18 and the ground plane 16. The beam steering element 32 is embedded in the second dielectric layer 20 typically in a direction transverse to and spaced from the radiating element 26. Preferably, the beam steering element 32 is embedded in the second dielectric layer 20 in a direction orthogonal to and spaced from the radiating element 26.

In a preferred embodiment, the beam steering element 32 is printed on the non-conductive pane 14. In this embodiment, all exposed surfaces of the beam steering element 32 are surrounded by the second dielectric layer 20. Although shown in FIGS. 2-4 as having a rectangular configuration (i.e., uniform width), it is to be appreciated that the beam steering element 32 may have other configurations. For instance, as shown in FIGS. 5-6, the beam steering element 32 may be tapered to gradually change the impedance of the beam steering element 32.

Figure 6:
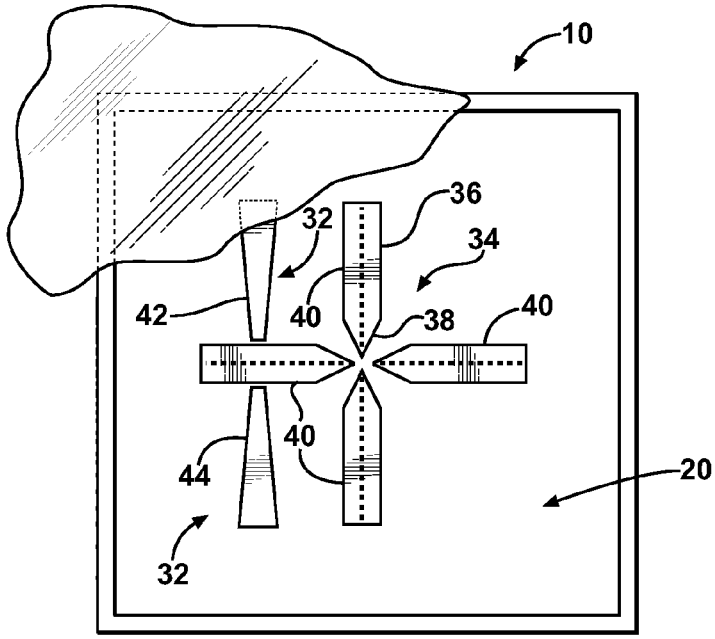
FIG. 6 is a top view of the antenna of FIG. 5.
Figure 7:
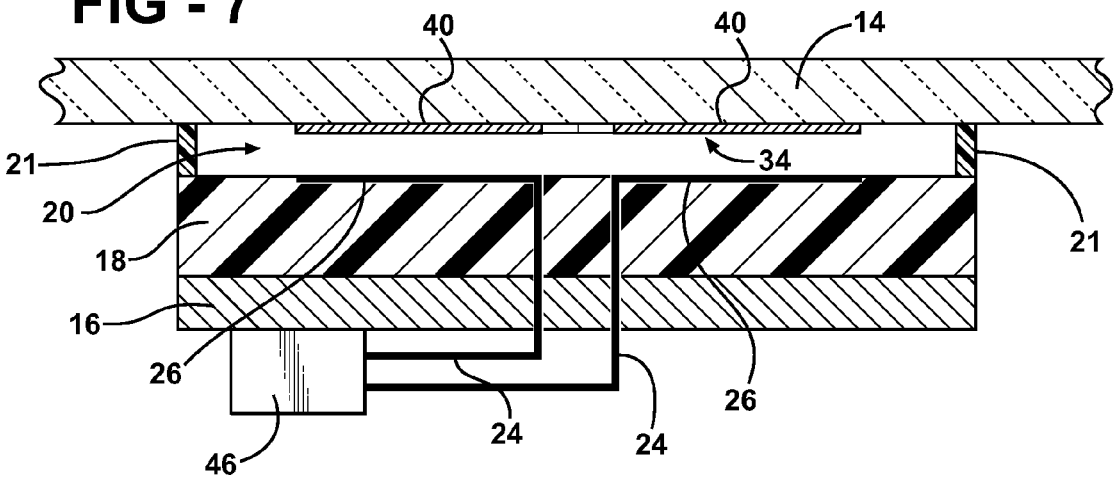
FIG. 7 is a cross-sectional side view of the antenna of FIG. 5 taken along the line 7-7 in FIG. 5.

Referring now to FIGS. 5-7, an impedance matching element 34 may be embedded in the second dielectric layer 20 and electromagnetically coupled to the at least one radiating element 26 to adjust the input impedance of the antenna 10. Preferably, the impedance matching element 34 is disposed on the non-conductive pane 14 and embedded in the second dielectric layer 20 parallel to the first dielectric layer 18 and the ground plane 16. However, the impedance matching element 34 does not necessarily have to be disposed on the non-conductive pane 14. The impedance matching element 34 also radiates with the at least one radiating element 26 to provide greater efficiency without signal loss. The impedance matching element 34 may include a first impedance matching section 36 and a second impedance matching section 38 integrally formed with the first impedance matching section 36. The first impedance matching section 36 has a uniform width. For example, the first impedance matching section 36 may have a rectangular configuration from a top view. The second impedance matching section 38 may be tapered from a top view to allow for gradual impedance matching.

In one embodiment, the impedance matching element 34 may have a plurality of impedance matching portions 40 each having the first impedance matching section 36 and the second impedance matching section 38. Furthermore, each impedance matching section is electromagnetically coupled to one of the plurality of radiating elements 26. Specifically, when the plurality of radiating elements 26 are arranged in the cross-dipole configuration, the plurality of impedance matching portions 40 are also arranged in a cross-dipole configuration spaced from the plurality of radiating elements 26. In this embodiment, it is preferred that each of the impedance matching portions 40 are positioned over one of the plurality of radiating elements 26.

The impedance matching element 34 is spaced from the beam steering element 32; however, positioning the impedance matching portion 40 over the radiating element 26 may cause the beam steering element 32 to come into physical contact with the impedance matching element 34. To prevent this, as shown in FIGS. 5 and 6, the beam steering element 32 may include a first beam steering portion 42 and a second beam steering portion 44 electromagnetically coupled to the first beam steering portion 42. In other words, the beam steering element 32 may be split into a first beam steering portion 42 and a second beam steering portion 44 spaced from the first beam steering portion 42. The first and second beam steering portions 42, 44 are further spaced from the impedance matching element 34. In order to allow for a gradual change in impedance, the first and second beam steering portions 42, 44 may be tapered from a top view.

Additionally, an amplifier 46 may be disposed on the ground plane 16. As illustrated in one embodiment, the amplifier 46 may be integrated with the ground plane 16. Furthermore, the ground plane 16 may be used to ground the amplifier 46. The amplifier 46 is electrically connected to the at least one feeding element 24 to amplify the RF signal received by the antenna 10. The amplifier 46 is preferably a low-noise amplifier (LNA) such as those well known to those skilled in the art.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed is:

1. An antenna comprising:

a ground plane;

a first dielectric layer disposed on said ground plane;

a second dielectric layer disposed on said first dielectric layer;

at least one feeding element embedded in said first dielectric layer;

at least one radiating element extending from said feeding element and embedded within said first dielectric layer adjacent to said second dielectric layer; and a beam steering element embedded in said second dielectric layer and electromagnetically coupled to said at least one radiating element.

2. An antenna as set forth in claim 1 wherein said beam steering element is embedded in said second dielectric layer in a direction transverse to and spaced from said at least one radiating element.

3. An antenna as set forth in claim 2 wherein said beam steering element is embedded in said second dielectric layer in a direction orthogonal to and spaced from said at least one radiating element.

4. An antenna as set forth in claim 1 wherein said beam steering element is embedded in said second dielectric layer parallel to said first dielectric layer.

5. An antenna as set forth in claim 1 wherein said beam steering element has a rectangular configuration from a top view.

6. An antenna as set forth in claim 1 further including an impedance matching element embedded in said second dielectric layer and electromagnetically coupled to said at least one radiating element.

7. An antenna as set forth in claim 6 wherein said at least one radiating element is further defined as a plurality of radiating elements and said impedance matching element has a plurality of impedance matching portions each electromagnetically coupled to one of said plurality of radiating elements.

8. An antenna as set forth in claim 7 wherein said at least one feeding element is further defined as a plurality of feeding elements and wherein said plurality of feeding elements and said plurality of radiating elements are arranged in a cross-dipole configuration and said plurality of impedance matching portions are arranged in a cross-dipole configuration spaced from said plurality of radiating elements.

9. An antenna as set forth in claim 8 wherein each of said impedance matching portions has a first impedance matching section and a second impedance matching section integrally formed with said first impedance matching section and wherein said first impedance matching section has a uniform width and said second impedance matching section is tapered from a top view.

10. An antenna as set forth in claim 6 wherein said impedance matching element is embedded in said second dielectric layer parallel to said first dielectric layer and said ground plane.

11. An antenna as set forth in claim 6 wherein said beam steering element includes a first beam steering portion and a second beam steering portion electromagnetically coupled to said first beam steering portion and wherein said first and second beam steering portions are spaced from said impedance matching element.

12. An antenna as set forth in claim 11 wherein said first and second beam steering portions each are tapered from a top view.

13. An antenna as set forth in claim 1 wherein said at least one feeding element is further defined as a plurality of feeding elements.

14. An antenna as set forth in claim 13 wherein said plurality of feeding elements are substantially perpendicular to said ground plane.

15. An antenna as set forth in claim 14 wherein said at least one radiating element is further defined as a plurality of radiating elements and wherein said plurality of radiating elements extend from each of said plurality of feeding elements parallel to said ground plane.

16. An antenna as set forth in claim 13 wherein said plurality of feeding elements are spaced from one another in said first dielectric layer.

17. An antenna as set forth in claim 13 wherein said at least one radiating element is further defined as a plurality of radiating elements and wherein said plurality of feeding elements and said plurality of radiating elements form a first dipole and a second dipole spaced from said first dipole in a cross-dipole configuration with said first and second dipoles for transmitting and receiving at least one first dipole signal and at least one second dipole signal, respectively, having equal magnitudes and a phase difference of 90 degrees.

18. An antenna as set forth in claim 1 wherein said first and second dielectric layers have a relative permittivity between 1 and 100.

19. An antenna as set forth in claim 18 wherein said relative permittivity of said first dielectric layer is different than said relative permittivity of said second dielectric layer.

20. A window having an integrated antenna, said window comprising:

a non-conductive pane;

a ground plane parallel to and spaced from said non-conductive pane;

a first dielectric layer disposed on said ground plane;

a second dielectric layer disposed on said first dielectric layer between said first dielectric layer and said non-conductive pane;

at least one feeding element embedded in said first dielectric layer;

at least one radiating element extending from said at least one feeding element and embedded within said first dielectric layer adjacent to said second dielectric layer; and a beam steering element embedded in said second dielectric layer and electromagnetically coupled to said at least one radiating element.

21. A window as set forth in claim 20 wherein said beam steering element is disposed on said non-conductive pane.

22. A window as set forth in claim 20 wherein said beam steering element is embedded in said second dielectric layer in a direction transverse to and spaced from said at least one radiating element.

23. A window as set forth in claim 22 wherein said beam steering element is embedded in said second dielectric layer in a direction orthogonal to and spaced from said at least one radiating element.

24. A window as set forth in claim 20 wherein said beam steering element is embedded in said second dielectric layer parallel to said first dielectric layer.

25. A window as set forth in claim 20 wherein said beam steering element has a rectangular configuration from a top view.

26. A window as set forth in claim 20 further including an impedance matching element embedded in said second dielectric layer and electromagnetically coupled to said at least one radiating element.

27. A window as set forth in claim 26 wherein said impedance matching element is disposed on said non-conductive pane.

28. A window as set forth in claim 26 wherein said at least one radiating element is further defined as a plurality of radiating elements and said impedance matching element has a plurality of impedance matching portions each electromagnetically coupled to one of said plurality of radiating elements.

29. A window as set forth in claim 28 wherein said plurality of radiating elements are arranged in a cross-dipole configuration and said plurality of impedance matching portions are arranged in a cross-dipole configuration spaced from said plurality of radiating elements.

30. A window as set forth in claim 29 wherein each of said impedance matching portions has a first impedance matching section and a second impedance matching section integrally formed with said first impedance matching section and wherein said first impedance matching section has a uniform width and said second impedance matching section is tapered from a top view.

31. A window as set forth in claim 26 wherein said impedance matching element is embedded in said second dielectric layer parallel to said first dielectric layer and said ground plane.

32. A window as set forth in claim 26 wherein said beam steering element includes a first beam steering portion and a second beam steering portion electromagnetically coupled to said first beam steering portion and wherein said first and second beam steering portions are spaced from said impedance matching element.

33. A window as set forth in claim 32 wherein said first and second beam steering portions each are tapered from a top view.

34. A window as set forth in claim 20 wherein said at least one feeding element is further defined as a plurality of feeding elements.

35. A window as set forth in claim 34 wherein said plurality of feeding elements are substantially perpendicular to said ground plane.

36. A window as set forth in claim 35 wherein said at least one radiating element is further defined as a plurality of radiating elements and each of said plurality of radiating elements extend from one of said plurality of feeding elements parallel to said ground plane.

37. A window as set forth in claim 34 wherein said plurality of feeding elements are spaced from one another in said first dielectric layer.

38. A window as set forth in claim 34 wherein said at least one radiating element is further defined as a plurality of radiating elements and wherein said plurality of radiating elements and said plurality of feeding elements form a first dipole and a second dipole spaced from said first dipole in a cross-dipole configuration with said first and second dipoles for transmitting and receiving at least one first dipole signal and at least one second dipole signal, respectively, having equal magnitudes and a phase difference of 90 degrees.

39. A window as set forth in claim 20 wherein said first and second dielectric layers have a relative permittivity between 1 and 100.

40. A window as set forth in claim 39 wherein said relative permittivity of said first dielectric layer is different than said relative permittivity of said second dielectric layer.

41. A window as set forth in claim 20 wherein said non-conductive pane is further defined as automotive glass.

42. A window as set forth in claim 41 wherein said automotive glass is further defined as soda-lime-silica glass.

* * * * *